US009136578B2

(12) United States Patent
Nguyen et al.

(10) Patent No.: US 9,136,578 B2
(45) Date of Patent: Sep. 15, 2015

(54) RECOMBINANT WAVEGUIDE POWER COMBINER / DIVIDER

(71) Applicant: ViaSat, Inc., Carlsbad, CA (US)

(72) Inventors: Dominic Quang Nguyen, Duluth, GA (US); Donald Lawson Runyon, Duluth, GA (US); Anders Jensen, Johns Creek, GA (US)

(73) Assignee: VIASAT, INC., Carlsbad, CA (US)

( * ) Notice: Subject to any disclaimer, the term of this patent is extended or adjusted under 35 U.S.C. 154(b) by 264 days.

(21) Appl. No.: 13/707,352

(22) Filed: Dec. 6, 2012

(65) Prior Publication Data

US 2013/0141186 A1 Jun. 6, 2013

Related U.S. Application Data

(60) Provisional application No. 61/567,586, filed on Dec. 6, 2011.

(51) Int. Cl.
*H01P 5/12* (2006.01)
*H01P 1/00* (2006.01)
(Continued)

(52) U.S. Cl.
CPC .. *H01P 5/12* (2013.01); *H01P 1/00* (2013.01); *H01P 11/001* (2013.01); *H01Q 21/0037* (2013.01); *Y10T 29/49002* (2015.01); *Y10T 29/49016* (2015.01)

(58) Field of Classification Search
CPC ..... H01P 5/12; H01P 1/00; H01P 1/213; H01P 11/001; H01Q 21/0037
USPC ..... 333/125, 126, 135, 137, 248
See application file for complete search history.

(56) References Cited

U.S. PATENT DOCUMENTS 4,467,294 A 8/1984 Janky et al.
4,743,915 A 5/1988 Rammos et al.
5,079,527 A * 1/1992 Goldfarb ..... 333/127
(Continued)

FOREIGN PATENT DOCUMENTS

WO 02/09227 A1 1/2002
WO 2006/061865 A1 6/2006
WO 2008/069369 A1 6/2008

OTHER PUBLICATIONS

Wu et al.; Analytical Design Method of Multiway Dual-Band Planar Power Dividers With Arbitrary Power Division; Dec. 2010; pp. 3832-3841.*

(Continued)

*Primary Examiner* — Benny Lee
*Assistant Examiner* — Rakesh Patel

(57) ABSTRACT

In an example embodiment, an in-phase recombinant waveguide combiner/divider device can comprise: a single waveguide input; N waveguide outputs, wherein N is an integer greater than 2; a first waveguide dividing portion; a second waveguide dividing portion; a third waveguide dividing portion; and a waveguide combining portion. The waveguide combining portion can be configured to combine two signals that are each respectively received from the second waveguide dividing portion and third waveguide dividing portion. In general an in-phase recombinant waveguide combiner/divider can comprise more junctions than output ports of a conservative power divider network structure. In an example embodiment, for a N-way waveguide power divider, there can be at least N+1 waveguide junctions.

20 Claims, 7 Drawing Sheets

(51) Int. Cl.
*H01P 11/00* (2006.01)
*H01Q 21/00* (2006.01)

(56) References Cited

U.S. PATENT DOCUMENTS

| | | | | |
|---|---|---|---|---|
| 5,243,357 | A | 9/1993 | Koike et al. | |
| 5,291,650 | A | 3/1994 | Carvalho et al. | |
| 5,473,294 | A * | 12/1995 | Mizzoni et al. | 333/113 |
| 5,568,160 | A | 10/1996 | Collins | |
| 5,736,908 | A | 4/1998 | Alexanian et al. | |
| 6,034,647 | A | 3/2000 | Paul et al. | |
| 6,118,353 | A * | 9/2000 | McKay | 333/125 |
| 6,201,508 | B1 | 3/2001 | Metzen et al. | |
| 6,411,174 | B1 | 6/2002 | Crouch et al. | |
| 6,563,398 | B1 | 5/2003 | Wu | |
| 7,927,402 | B1 | 4/2011 | Grzeslak et al. | |
| 2004/0178863 | A1 | 9/2004 | Chan et al. | |
| 2006/0226931 | A1 | 10/2006 | Tavassoli Hozouri | |
| 2007/0182507 | A1 | 8/2007 | Chang et al. | |
| 2011/0061539 | A1 | 3/2011 | Lam et al. | |
| 2011/0153283 | A1 | 6/2011 | Kohara et al. | |
| 2011/0156838 | A1 | 6/2011 | Huang et al. | |
| 2011/0267250 | A1 | 11/2011 | Seifried et al. | |
| 2012/0218160 | A1 | 8/2012 | Montgomery et al. | |
| 2013/0154764 | A1 | 6/2013 | Runyon et al. | |

OTHER PUBLICATIONS

Dittloff et al., Computer Aided Design of Optimum E- or H-Plane N-Furcated Waveguide Power Dividers, 17th European Microwave Conference, Sep. 7, 1987 to Sep. 11, 1987, pp. 181-186.
Goldfarb, A Recombinant, In-Phase Power Divider, IEEE Transactions on Microwave Theory and Techniques, vol. 39, No. 8, Aug. 1991, pp. 1438-1440.
Rebollar et al., Design of a Compact Ka-Band Three-Way Power Divider, IEEE, 1994, 0-7803-2009-3/94, pp. 1074-1077.
Sehm et al., A Large Planar Antenna Consisting of an Array of Waveguide FED Horns, 26th EuMC, Sep. 9, 1996 to Sep. 12, 1996, Prague, Czech Republic, pp. 610-613.
Christopher et al., Design Aspects of Compact High Power Multiport Unequal Power Dividers, IEEE, 1996, 0-7803-3232-6/96, pp. 63-67.
Dudko et al., A Wide Band Matching of H-Plane TEE, MMET '96 Proceedings, Lviv, Ukraine, VIth Int'l. Conf. on Mathematical Methods in Electromagnetic Theory, 1996, pp. 309-312.
Joubert et al., Design of Unequal H-Plane Waveguide Power Dividers for Array Applications, IEEE, 1996, 0-7803-3216-4/96, pp. 1639-1639.
Wollack, On the Compensation of E-Plane Bifrucations in Rectangular Waveguide, NRAO, Charlottesville, VA, Oct. 20, 1997.
Gardner et al., Mode Matching Design of Three-Way Waveguide Power Dividers, The Institute of Electrical Engineers, 1997, London, UK, 4 pgs.
Sehm et al., A Large Planar 39-Ghz Antenna Array of Waveguide-FED Horns, IEEE Transactions on Antennas and Propagation, vol. 46, No. 8, Aug. 1998, pp. 1189-1193.
Soroka et al., Simulation of Multichannel Waveguide Power Dividers, MSMW '98 Symposium Proceedings, Kharkov, Ukraine, Sep. 15, 1998 to Sep. 17, 1998, pp. 634-635.
Sehm et al., A 38 Ghz Horn Antenna Array, 28th European Microwave Conference Amsterdam 1998, pp. 184-189.
Hersey et al., Self Regenerating Desiccant for Water Management in External Aircraft Electronics, IEEE, Aerospace Conference, Mar. 6, 1999 to Mar. 13, 1999, pp. 183-191.
Sehm et al., A High-Gain 58-Ghz Box-Horn Array Antenna With Suppressed Grating Lobes, IEEE Transactions on Antennas and Propagation, vol. 47, No. 7, Jul. 1999, pp. 1125-1130.
Sehm et al., A 64-Element Array Antenna for 58 Ghz, IEEE, 1999, 0-7803-5639-X/99, pp. 2744-2747.
Kerr, Alma Memo 381—Elements for E-Plane Split-Block Waveguide Circuits, http://www.mma.nrao.edu/memos/, Jul. 5, 2001.
Bozzi et al., A Compact, Wideband, Phase-Equalized Waveguide Divider/Combiner for Power Amplification, 33rd European Microwave Conference, Munich, 2003, pp. 155-158.
Yang et al., Synthesis of a Compound T-Junction for a Two-Way Splitter With Arbitrary Power Ratio, IEEE, 2005, 0-7803-8846-1/05, pp. 985-988.
Panda et al., Multiple Cavity Modeling of a Feed Network for Two Dimensional Phased Array Application, Progress in Electromagnetics Research Letters, vol. 2, 2008, pp. 135-140.
Mestezky et al., Unequal, Equi-Phase, 1:N Power Divider Based on a Sectoral Waveguide, Int'l. Journal of Microwave and Optical Technology, vol. 4, No. 3, May 2009, pp. 170-174.
Kim et al., Design of High Power Split Waveguide Array in W-Band, IEEE, 2009, 978-1-4244-5417-4/09, 2 pgs.
Chen et al., An Ultra Wide Band Power Divider/Combiner Based on Y-Structure Waveguide, IEEE, ICMMT 2010 Proceedings, 2010, 978-1-4244-5708-3/10, pp. 853-855.
Non-Final Office Action mailed in U.S. Appl. No. 13/707,049 on Oct. 24, 2014, 9 pgs.
Notice of Allowance mailed in U.S. Appl. No. 13/707,049 on Mar. 27, 2015, 10 pgs.

* cited by examiner

RECOMBINANT WAVEGUIDE POWER COMBINER / DIVIDER

CROSS-REFERENCE TO RELATED APPLICATIONS

This application claims priority to U.S. Provisional Application No. 61/567,586, entitled "Mobile Antenna," which was filed on Dec. 6, 2011, the contents of which are hereby incorporated by reference for any purpose in their entirety.

FIELD OF INVENTION

The present disclosure relates generally to waveguide power combiners/dividers in radio frequency (RF) antenna devices, and specifically to recombinant N way power combiners/dividers.

BACKGROUND

Radio frequency (RF) power distribution networks can be used to divide a RF input signal at a single input into N RF output signals at N outputs. Viewed from another perspective, the RF power distribution networks can be used to combine N RF input signals at N inputs into a single RF output signal at a single output. In a transceiver embodiment, antenna arrays and feeds use power distribution networks for RF signal communication between the antenna array and a single RF input/output. In large antenna arrays and/or high frequency (microwave type, e.g., Ku-band and Ka-band) antenna arrays, power losses in the power distribution network can be a significant problem.

Waveguide technology can be used to implement the power distribution network. Waveguide technology can be significantly better than other options because waveguide technology has the benefit of low power loss. In contrast, stripline technology, for example, has a relatively high loss, compared to waveguide technology, for large high frequency arrays and feed networks.

Antenna arrays for Ku-band and Ka-band satellite communications (SATCOM) applications typically can be required to have advanced aperture distribution functions to comply with regulations. Precise amplitude and phase control can therefore be beneficial for successful implementation of power distribution networks. In addition, antenna arrays can be designed to perform simultaneous transmit and receive and dual polarized operation over diverse frequency bands. It is typically a design objective to make antennas for use in aerospace applications be light weight, Unfortunately, existing waveguide power distribution devices can generate unacceptable amplitude and phase errors, have limited bandwidth, limited power split ratio capabilities, and/or can be too large, heavy, or bulky for many applications. Similarly, magic-tees having 4 ports are not well suited for integration into compact layered structures. Magic tees have load termination aspects that add complexity and cost to the system.

Therefore, a new waveguide RF power distribution technology is described herein that can provide (relative to the prior art) one or more of; low amplitude errors, low phase errors, wide bandwidth, low cost, low complexity, light weight, and low return loss for N way power combiners/dividers.

SUMMARY

In an example embodiment, an in-phase recombinant three-way waveguide (WG) device comprises a first WG port, wherein the first WG port can be a common port, and second, third, and fourth WG ports. The recombinant three-way WG device can be configured to simultaneously: distribute a transmit signal, provided at the common port, as three separate signals respectively at the second, third and fourth WG ports; and to combine three receive signals respectively from the second, third and fourth WG ports into a single signal at first WG port. In this example embodiment, a signal communicated between the common port and the fourth WG port is split before it is combined with a portion of itself In this example embodiment, at least one of signals in a first band communicated via the second, third, and fourth WG ports can be in-phase with each other, and signals in a second band communicated via the second, third, and fourth WG ports can be in-phase with each other.

In an example embodiment, an in-phase recombinant waveguide combiner/divide device can comprise: a single waveguide input; N waveguide outputs, wherein N is an integer greater than 2; a first waveguide dividing portion; a second waveguide dividing portion; a third waveguide dividing portion; and a waveguide combining portion. The waveguide combining portion can be configured to combine two signals that are each respectively received from the second waveguide dividing portion and third waveguide dividing portion.

In an example embodiment, a method for building an in-phase recombinant waveguide device can comprise: forming a first WG port in a substrate, wherein the first WG port can be a common port; forming second, third, and fourth WG ports in the substrate. In this example embodiment, the recombinant three-way WO device can be configured to simultaneously; distribute a transmit signal provided at the common port into three separate signals respectively at the second, third and fourth WG ports; and combine three receive signals respectively from the second, third and fourth WO ports into a single signal at first WG port. In this example embodiment, a signal communicated between the common port and the fourth WG port is split before it is combined with a portion of itself In this example embodiment, at least one of: signals in a first band communicated via the second, third, and fourth WO ports can be in-phase with each other, and signals in a second band communicated via the second, third, and fourth WG ports can be in-phase with each other.

BRIEF DESCRIPTION OF THE DRAWING FIGURES

Additional aspects of the present invention will become evident upon reviewing the non-limiting embodiments described in the specification and the claims taken in conjunction with the accompanying figures, wherein like numerals designate like elements, and:

DETAILED DESCRIPTION

Figure 1:
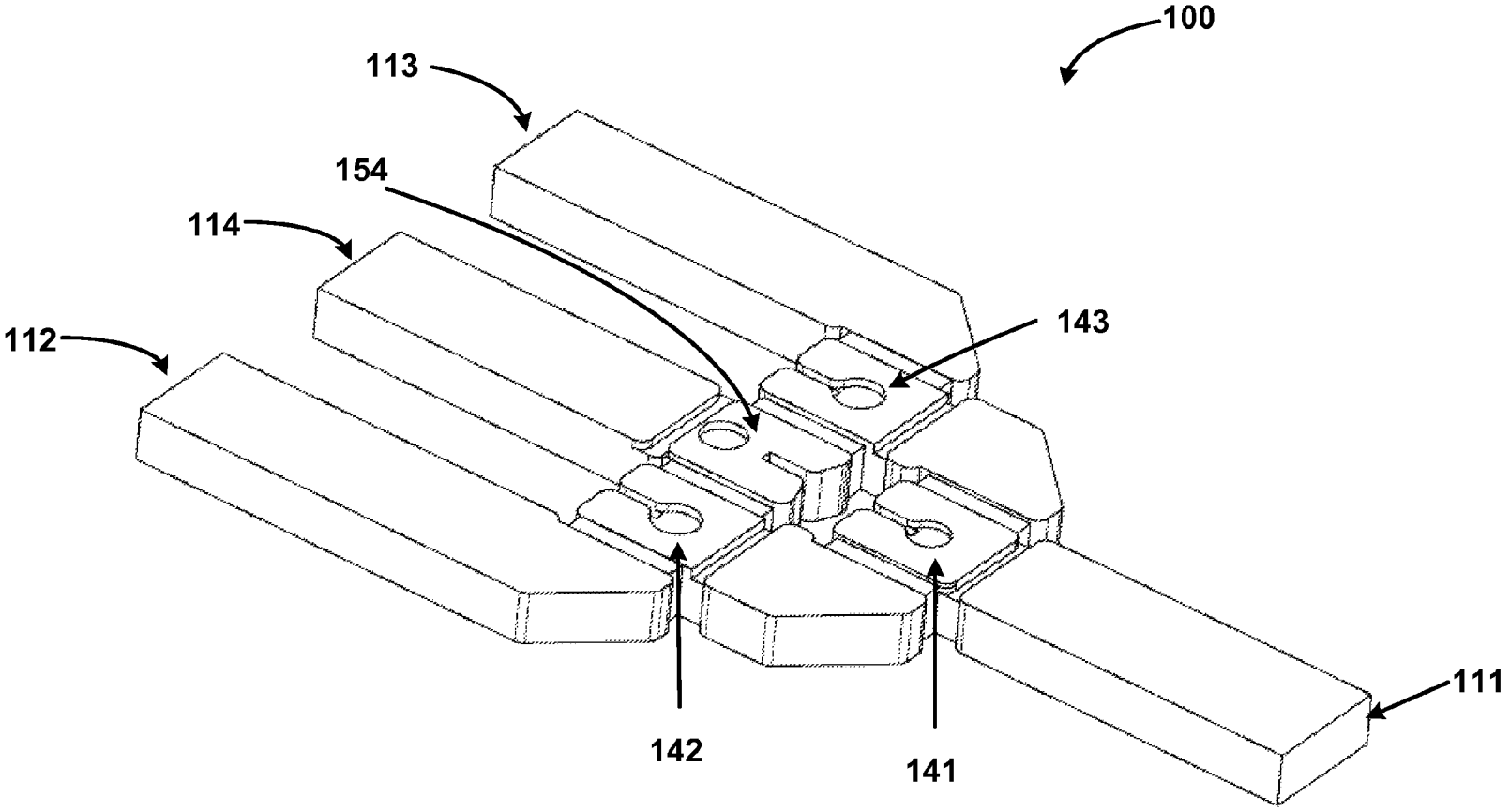
FIG. 1 is a perspective view of an example recombinant three way (N=3) power combiner/divider comprised of four (N+1) waveguide junctions.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In conventional RF antennas, the antenna size, frequency bands of operation, and performance criteria may define values of N RF outputs that are binary or regular powers of two (e.g., N=2, 4, 8, 16, 32, 64, etc.), and these can typically be implemented with binary type power distribution networks. These conventional binary power divider/combiner networks may be comprised of N−1 junctions. In contrast, in an example embodiment, a recombinant power combiner/divider network can comprise at least N+1 junctions. A waveguide power divider/combiner is disclosed, in an example embodiment, that can comprise a non-binary number of ports N (e.g., N=3, 5, 6, 9, etc.) at the majority interface and that can comprise more than N−1 waveguide junctions. The waveguide power divider/combiner can be configured to enable low-loss power distribution networks. The recombinant waveguide power divider/combiner can use at least one additional (greater than N−1) waveguide junctions to implement power distribution network topologies for non-binary majority port topologies in constrained power distribution having high signal integrity of phase and amplitude, In accordance with various aspects, an in-phase recombinant waveguide combiner/divider device can comprise a single waveguide (WG) input, N WG outputs, a first WG dividing portion, a second WO dividing portion, a third WG dividing portion, and a WG combining portion. In other words, an in-phase recombinant waveguide combiner/divider device with N WG outputs can comprise at least N+1 WG junctions. In this example embodiment, the WG combining portion can be configured to combine two signals that were respectively received from the second and third WG dividing portions. Moreover, N can he an integer greater than 2. In one example embodiment, N equals the integer three. In other example embodiments, N equals the integer five. In other example embodiments, N equals the integer six. Moreover, N may equal any integer greater than 2. In an example embodiment, the number of WG junctions can be greater than the number N.

The terms "divider" or "waveguide dividing portion" can be used to indicate a physical portion of the WG structure that is configured to divide an RF signal into two RF signals. Similarly, the terms "combiner" or "waveguide combining portion" can be used to indicate a physical portion of the WG structure that is configured to combine two RF signals into a single RF signal. The same power distribution network structure can be used in a system that comprises: a transmitter, a receiver, or a transceiver. It is noted that in a transceiver type embodiment, a divider in the power distribution device from the transmit perspective can be a combiner from the receive perspective. Thus, in an example embodiment, the distribution network, or waveguide combiner/divider, can be a passive reciprocal structure.

Therefore, for sake of clarity in discussing the example embodiments, the examples disclosed herein are generally discussed herein from a transmit perspective. Stated another way, examples discussed herein are generally with reference to providing to an input port a single signal that is distributed as described herein to more than two output ports (N>2). Nevertheless, the use of such language to identify the components of the device is not intended to limit the scope of the description of the invention to only a transmit type device. It should be understood that the same distribution network may be used in a receiver context or a transceiver context, with the parts denominated as fits the respective perspective, With reference now to FIG. 1, an example in-phase recombinant three-way (N=3) waveguide combiner/divider device 100 can comprise a single WG input 111, three WG outputs 112-114, at least one WG dividing portion, and at least one WG combining portion. In an example embodiment, waveguide combiner/divider device 100 comprises four (N+1) waveguide junctions; three for dividing and one for combining. In this particular example embodiment, the at least one WG dividing portion comprises a first WG dividing portion 141, a second WG dividing portion 142, and a third WG dividing portion 143. In this example embodiment, the at least one WG combining portion comprises WG combining portion 154. The at least one WG combining portion can be configured to combine two signals that each were divided the in at least one WG dividing portion of the device. Namely, the WG combining portion 154 can be configured to combine two signals that were respectively received from the second WG dividing portion 142 and the third WG dividing portion 143. The in-phase recombinant three-way waveguide combiner/divider device 100, in an example embodiment, can comprise four waveguide junctions.

In another example embodiment, and stated in terms that are not transmit/receive dependent, in-phase recombinant three-way waveguide combiner/divider device 100 can comprise a first WG port 111, and a second WG port 112, a third WG port 113, and a fourth WG port 114. Device 100 can comprise four waveguide ports 111-114 and four waveguide junctions 141-143, 154. In this example embodiment, the first WG port 111 can he a common port. The common port can be configured to communicate a signal comprising the signals communicated via the second, third and fourth WG ports 112-114. Second, third and fourth WG ports 112-114 can each be configured to communicate a portion of the composite signal communicated by WG port 111.

In the context of a transceiver, the recombinant three-way WG device 100 can be configured to simultaneously: distribute a transmit signal, which can be provided at the common port, as three separate signals respectively at the second, third and fourth WG ports; and combine three receive signals respectively from the second, third and fourth WG ports into a single signal at the first WG port. Thus, in this example embodiment, the three-way (N=3) WG device 100 can comprise four (N+1) waveguide junctions.

With continued reference to FIG. 1, recombinant three-way WG device 100 can comprise a first junction 141, a second junction 142, a third junction 143, and a fourth junction 154. In this embodiment, first junction 141 is connected to first WG port 111 and to second junction 142 and third junction 143. Second junction 142 is connected to second WG port 112 and fourth junction 154. Third junction 143 is connected to third WG port 113 and fourth junction 154. Fourth junction 154 is connected to fourth WG port 114.

Moreover, recombinant three-way (N=3) WG device 100 can comprise any arrangement of waveguide junctions configured so that a signal, part of which is communicated between the common port and the fourth WG port, is split before it is combined with a portion of itself. Stated another way, recombinant three-way WG device 100 can comprise any arrangement of waveguide junctions wherein a signal, part of which is communicated between the common port and the fourth WG port, is split into at least four (N+1) signals in-between the common port and the fourth WG port.

In this example embodiment, and from a transmit perspective, a transmit signal at common port 111 can be transmitted from the second, third and fourth WG ports (112-114) (e.g., transmitted to a satellite or the like). In this example transmit embodiment, the first, second, and third junctions (141-443) can be WG dividers and the fourth junction 154 can be a WG combiner. In this same example embodiment, and from a receive perspective, signals received (e.g., from a satellite, or the like) at the second, third, and fourth WG ports (112-114) can be communicated via the common port 111 to, for example, a transceiver and ultimately to a modem. In this example receive embodiment, the first, second, and third junctions (141-143) can be WO combiners and the fourth junction 154 can be a WG divider. In this example embodiment, from a transmit point of view, the device can comprise one input and three outputs, and from a receive point of view, the device can comprise three inputs (N=3), four (N+1) junctions, and one output.

In one example embodiment, the WG dividing portion is an equal way dividing portion. An equal way dividing portion can be configured to divide an RF signal into two equal strength RF signals having the same frequency as the original RF signal. In another example embodiment, the WG dividing portion is an unequal way dividing portion. An unequal way dividing portion can be configured to divide an RF signal into two RF signals of different power relative to each other, both having the same frequency as the original RF signal. For example, an unequal way power divider may divide the power of an RF signal in a ⅓ to ⅔ ratio. For example, the second and third WG ports may be configured to each receive ⅔rds of the power of the signal provided to the second and third junctions, and the fourth WG port may be configured to receive ⅓rd the power of the signal provided to each of those junctions from each of those junction (totaling another ⅔rds). In this way, the power of the signal from each WG port 112-114 can be caused to be approximately equal. Moreover, power divider 141-143 may divide the signals by any suitable ratio. When stating herein that the signals have the same frequency, it is intended that the signals may have frequencies that vary slightly from each other, by for example, no more than 0.5 dB amplitude and 22.5 degrees (π/8 radians) phase. The requirements for the maximum tolerance for amplitude and phase deviations can depend on the application. In antenna beamforming applications where maximum power transfer is a primary consideration, deviation from the ideal values can result in less than the optimum performance.

In one example embodiment, the first junction 141 and fourth junction 154 can be equal-way junctions and the second junction 142 and third junction 143 can be unequal-way junctions. In another example embodiment, the signal output amplitudes at the second 112, third 113, and fourth 114 WG ports are one of (a) all equal, and (b) equal on the second 112 and third 113 WG ports and greater on the fourth 114 WG port.

In one example embodiment, in-phase recombinant N-way power combiner/divider is not a cavity type combiner/divider. As used herein a cavity type combiner/divider comprises a waveguide junction where, apart from the waveguide portions connecting to the junction, the cavity portion has a width and/or height greater than approximately two times the width of the waveguide. Such a cavity would be a large cavity, and the in-phase recombinant N-way power combiner/divider, in an example embodiment, does not have a large cavity.

In another example embodiment, in-phase recombinant N-way power combiner/divider can be a passive reciprocal device. The waveguides used in the in-phase recombinant N-way power combiner/divider can be rectangular waveguides. In an example embodiment, the waveguide can be sized for dominant mode signal transmission where the width and height of the waveguide can have a dimension (width "a" and height "b") where "a" is greater than $\lambda_L/2$ and less than $\lambda_H$ where $\lambda_L$ is the free-space wavelength at the lowest operational frequency and $\lambda_H$ is the free-space wavelength at the highest operational frequency. Waveguide height "b" can be selected to be less than "a" to avoid a degenerate or higher order mode of signal transmission. In an example embodiment, the lower frequency limit can establish a lower limit to the waveguide size as it is the "waveguide cutoff" where signal transmission effectively ceases. In practical applications it can be desirable for the waveguide size to be selected to avoid operation less than 8% above the cutoff value ($\lambda_L$>1.08a/2) because, for example, the loss can increase as the cutoff value (λ=a/2) is approached. In applications where there is significant length of waveguide involved in the power distribution network, the lower limit can be constrained to be 12% above the cutoff value ($\lambda_L$>1.12a/2). In an example embodiment, the higher frequency limit ($\lambda_H$<a) can restrict higher order mode transmission that can be deleterious to the objective signal transmission performance. Practically it can be useful to define a margin below the limit and this margin can be tied to the achievable manufacturing tolerances. For precision manufacturing a limit can be defined that is 2% below the theoretical value ($\lambda_H$<0.98a). Thus, as a practical limit, the rectangular waveguide can be configured, in an example embodiment, to operate over a band or set of bands that have a ratio of the highest frequency to the lowest frequency of (2*0.98/1.08=) 1.815 and typically no more than (2*0.98/1.12=) 1.75 for applications involving significant lengths of waveguide and precision manufacturing technology. Conventional or standard waveguide bands are defined with ratios of 1.5 (e.g., encompassing 12-18 GHz). An example device designed to operate over the 18.3 to 30.0 GHz range can correspond to a ratio of (30/18.3=) 1.639 and can have a greater bandwidth range than the standard rectangular waveguide frequency allocation. Thus, an in-phase recombinant N-way waveguide combiner/divider device can operate over a band of frequencies who's width is greater than that of a standard waveguide band (i.e., 1.5) even at high performance (i.e., return loss less than −20 dB). In an example embodiment, an in-phase recombinant N-way waveguide combiner/divider device can be configured to operate with a ratio of 1.5.

In an example embodiment, the recombinant three-way power combiner/divider device can be configured to provide substantially fiat phase and amplitude across wide frequency bands. The device can be a dual band device having first and second frequency bands of operation. In accordance with various aspects, the first band can be a receive frequency band. In an example embodiment, the receive frequency band can be from 17.7 to 21.2 GHz, from 17.7 to 20.2 or from 18.3 to 20.2 GHz. Moreover, the receive frequency band can be any suitable frequency band. In accordance with various aspects, the second band can be a transmit frequency band. In an example embodiment, the transmit frequency band can be from 27.5 to 31.0 GHz, from 27.5 to 30.0 GHz, or from 28.1 to 30.0 GHz. Moreover, the transmit frequency band can be any suitable frequency band. The wide frequency band discussed herein can he the frequency bandwidth between the lowest receive frequency of operation to the highest transmit frequency of operation.

Figure 2:
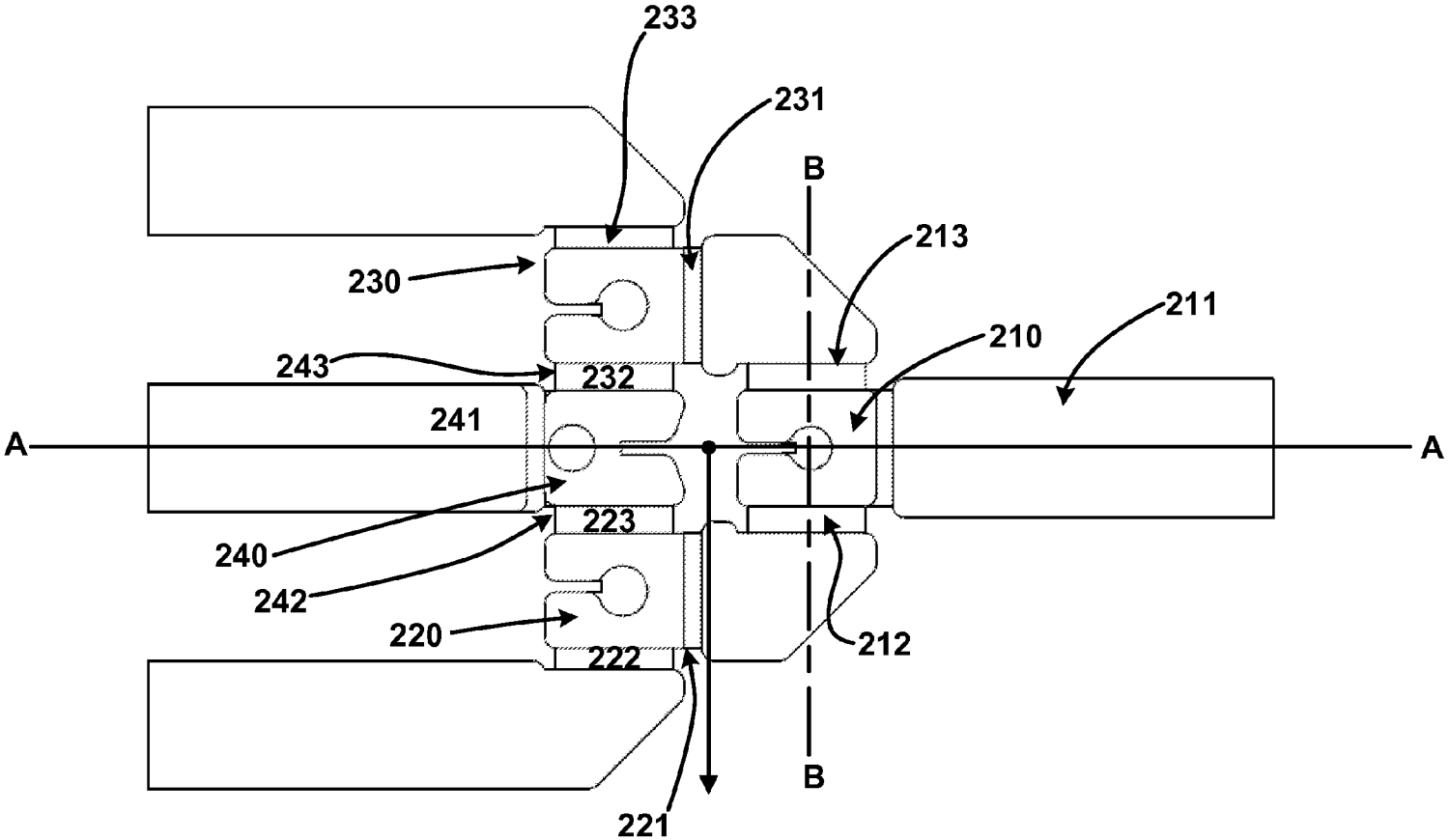
FIG. 2 is a plan view of an example recombinant three way (N=3) power combiner/divider comprised of four (N+1) waveguide junctions.

In an example embodiment, and with reference to FIG. 2, an in-phase recombinant N-way power combiner/divider junction has a longitudinal axis A-A, which bisects the common (input) waveguide for that junction. Similarly, in-phase recombinant N-way power combiner/divider has a cross axis B-B, which is perpendicular to the axis A-A and bisects the output waveguides for that junction.

Thus, a first junction 210 may comprise a common waveguide 211 and two output waveguides 212/213. A second junction 220 may comprise a common junction 221 and two output waveguide 222/223. A third junction 230 may comprise a common junction 231 and two output waveguides 232/233. A fourth junction 240 may comprise two input waveguides 242 and 243 and a common (output) waveguide 241. The longitudinal axis A-A of first junction 210 can be configured to bisect common waveguide 211 and cross axis B-B can be perpendicular to axis A-A and bisect the opposite facing output waveguides 212/213. Similar axis can be defined for each junction, relative to that junction. Thus, first junction 210 can he connected to second junction 220 via waveguides 212 and 221. Between waveguides 212 and 221 can be a section containing a first waveguide bend. First junction 210 can be connected to third junction 230 via waveguides 213 and 231. Between waveguides 213 and 231 can be a section containing a second waveguide bend. Second junction 220 can be connected to fourth junction 240 through waveguide 223 and third junction 230 can be connected to fourth junction 240 through waveguide 232. Waveguides 222 and 233 can also be connected to second and third waveguide ports 112 and 113 respectively through a waveguide bend. The junctions can also comprise an iris. Thus, the in-phase recombinant N-way power divider can have N output ports, a single input port, and can comprise N+1 junctions. In another example embodiment, the in-phase recombinant N-way power combiner can have N input ports, a single output port, and can comprise N+1 junctions.

In accordance with an example embodiment, each first, second, third, and fourth junction comprises a T-junction. Moreover, in one example embodiment, each T-junction can comprise an H-plane T-junction. An H-plane T-junction can comprise: a first H-plane T-junction port; a second H-plane T-junction port; a third H-plane T-junction port; and a septum. The first H-plane T-junction port can comprise a common port. In a transmit perspective, the common port may be an input port, and the second and third H-plane T-junction ports may be output ports. The first port can be arranged as the leg of the T and the second and third ports can be arranged as the arms of the T. Thus, in an example embodiment, the first port is perpendicular to the orientation of the output ports, which face away from each other. It is noted, that although described herein as a T-junction, the waveguide channels connecting to the three ports of the T-junction can be laid out in any directions and my thus turn very near the T-junction. In an example embodiment, the septum is configured to match impedance of the input waveguide to the input impedance of the power divider and/or to minimize return loss.

In a first example embodiment, the septum is an H-plane septum. In one embodiment, the H-plane septum can be a floor to ceiling septum. Stated another way, the H-plane septum may extend the full height of the waveguide H-plane T-junction. In an example embodiment, the H-plane septum is an inductive septum. The H-plane septum can be configured to extend from a conductive rear wall of the WG, i.e., the top of the T-junction, parallel to the longitudinal axis, A-A, of the input port/input WG. In an example embodiment, the H-plane septum may have the form of a dividing wall extending only partially from the top of the T of the T-junction down the leg of the T. The H-plane septum can be configured to help divide a signal at the common port into two signals provided respectively at the second and third ports. In accordance with various example embodiments, the H-plane septum is generally triangular in shape. In accordance with other example embodiments, the H-plane septum is linear or generally rectangular. Moreover, the H-plane septum can comprise any shape suitable for dividing the signal in power proportions that are equal or non-equal.

In a second example embodiment, the septum is an E-plane septum. In one embodiment, the E-plane septum can be a wall to wall septum. Stated another way, the E-plane septum may extend the full width of the waveguide H-plane T-junction. In an example embodiment, the E-plane septum is a capacitive septum. The E-plane septum can be configured to help divide a signal at the common port into two signals provided respectively at the second and third ports. Thus, the E-plane septum divides the signal received at the common port into a top waveguide channel and a bottom waveguide channel. The top waveguide channel curves 90 degrees to form one arm of the H-plane T-junction, and the bottom waveguide channel curves 90 degrees in the direction opposite the one arm to form the other arm of the H-plane T-junction. The two arms of the H-plane T-junction may step up or down as the case may be, to come back to the height of the WG input at the common port.

Further disclosure relative to the H-plane T-junction and H-plane/E-plane septums can be found in U.S. patent application Ser. No. 13/707,049,entitled "In-Phase H-Plane Waveguide T-Junction With E-Plane Septum," and filed Dec. 6, 2012 on the same date as this application, which is incorporated by reference in its entirety. In an example embodiment, each H-type T-junction comprises one of: an E-plane septum or an offset asymmetric septum.

Figure 3:
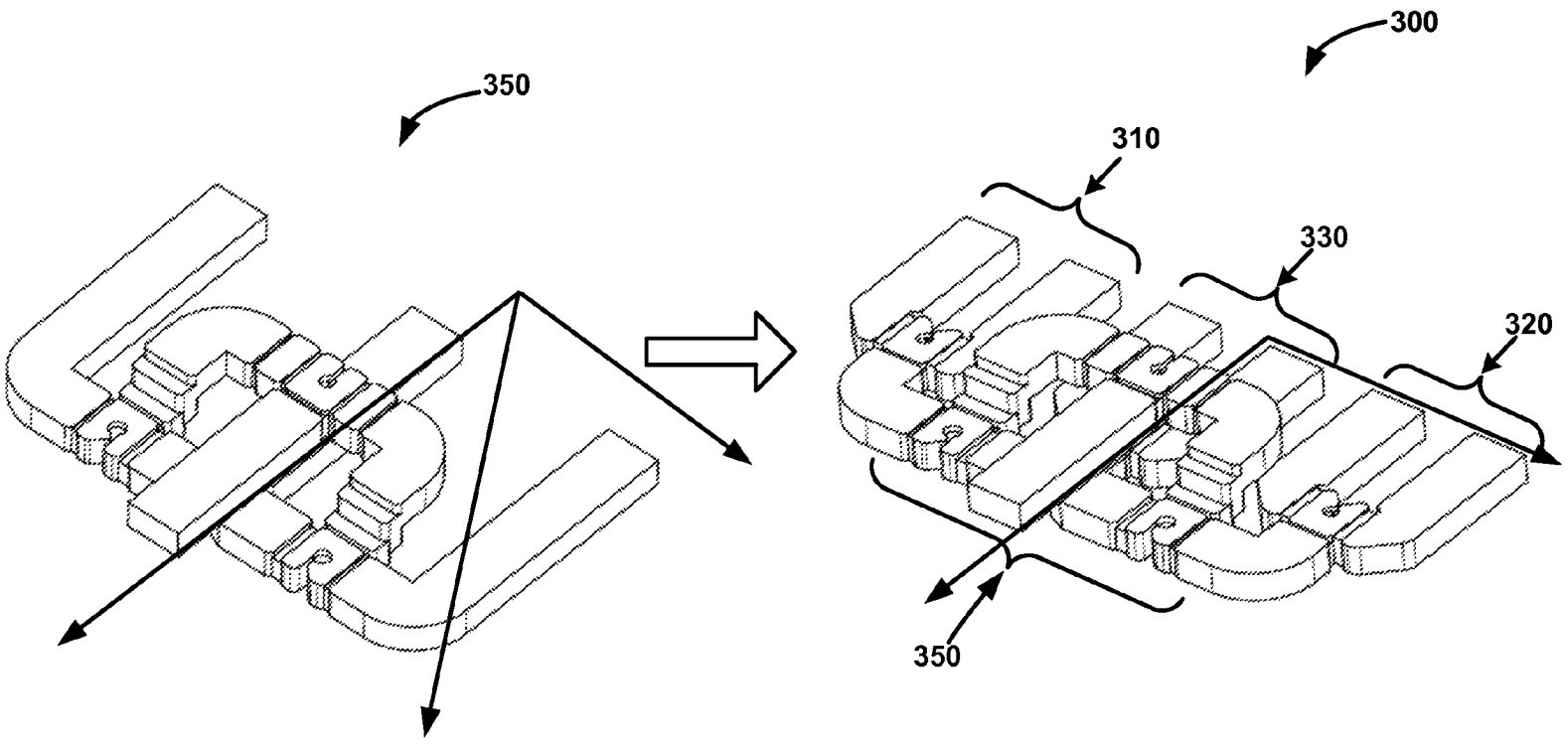
FIGS. 3 and 4 are top and bottom perspective views of an example six-way (N=6) power combiner/divider, respectively comprised of seven (N+1) waveguide junctions.
Figure 4:
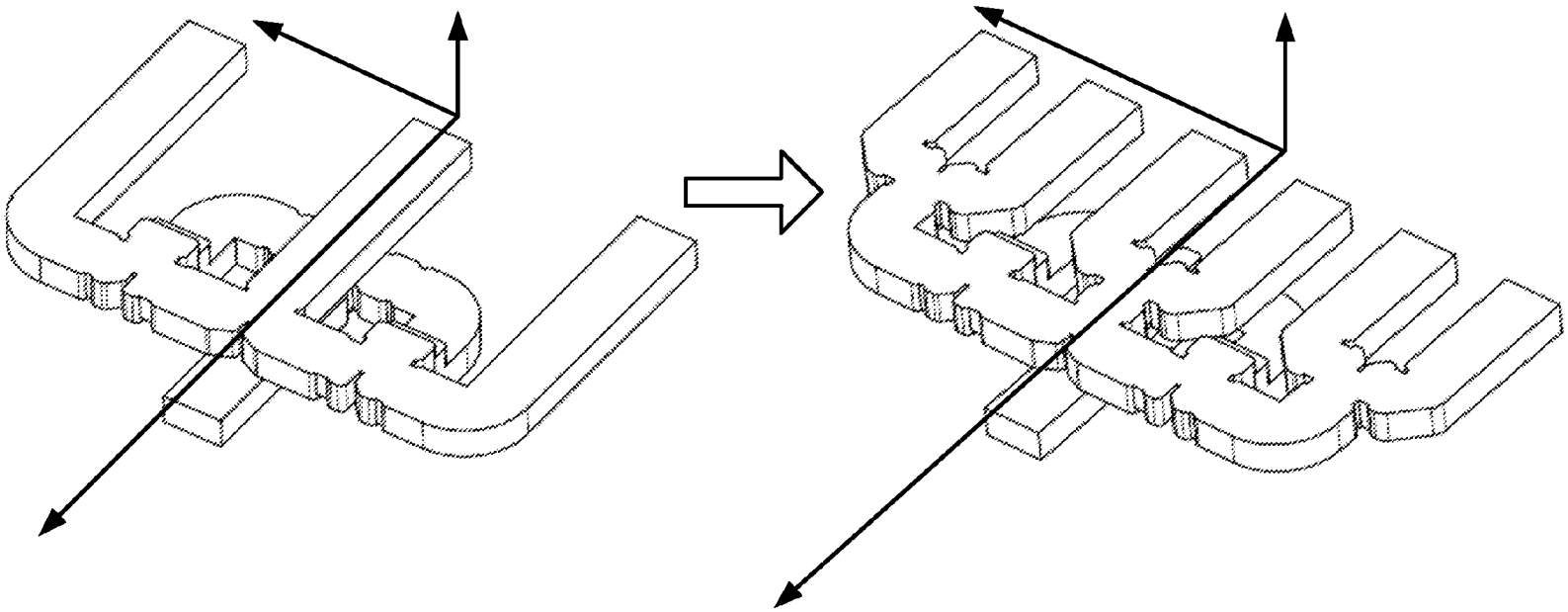

With reference now to FIGS. 3 and 4, the recombinant power combiner/divider may comprise higher order embodiments, where N is greater than 3. In one example embodiment, a three-way recombinant power combiner is used as a base building block for constructing higher order power combiner/divider networks. Stated another way, a higher order power combiner/divider network can comprise a recombinant three-way waveguide device.

For example, a recombinant three-way power combiner/divider 350 may form a part of recombinant six-way power combiner/divider 300. In an example embodiment, recombinant six-way power combiner/divider 300 comprises a recombinant three-way power combiner/divider 350, a first two-way WG junction 310, a second two-way WG junction 320, and a third two-way WG junction 330. In this example embodiment, the three two-way WG junctions (310, 320, 330) are respectively connected via their common port to each of the second, third, and fourth WG ports of recombinant three-way power combiner/divider 350 to form a six-way recombinant splitter/combiner 300. Six-way recombinant splitter/combiner 300 comprises a common port and six output ports. In this example embodiment, the three-way (N=3) recombinant power combiner/divider can comprise N+1 waveguide junctions. The corresponding six-way (N=6) recombinant power combiner/divider can comprise seven (N+1) junctions. In contrast, a conventional six-way power combiner/divider has five (N−1) junctions.

It is noted that a combination of two-way WG junctions with a three-way recombinant power combiner/divider can be used to form higher order recombinant power combiner/divider structures. Moreover, more than one recombinant power combiner/divider structures can be combined with or without two-way WG junctions to firm higher order recombinant power combiner/divider structures. As one example not illustrated, if two three-way (N=3) recombinant power combiner/divider structures are used together with a two-way junction to form a six-way power combiner/divider structure there can be nine (N+3) waveguide junctions in the structure. This example contains four more junctions than a conventional six-way power combiner/divider. In various example embodiments, the N-way recombinant waveguide power combiner/divider structure can comprise a total number of junctions greater than N. In contrast, a conventional waveguide power combiner/divider structure comprised of two-way power/combiner junctions has a total number of waveguide junctions equal to N−1.

Figure 5:
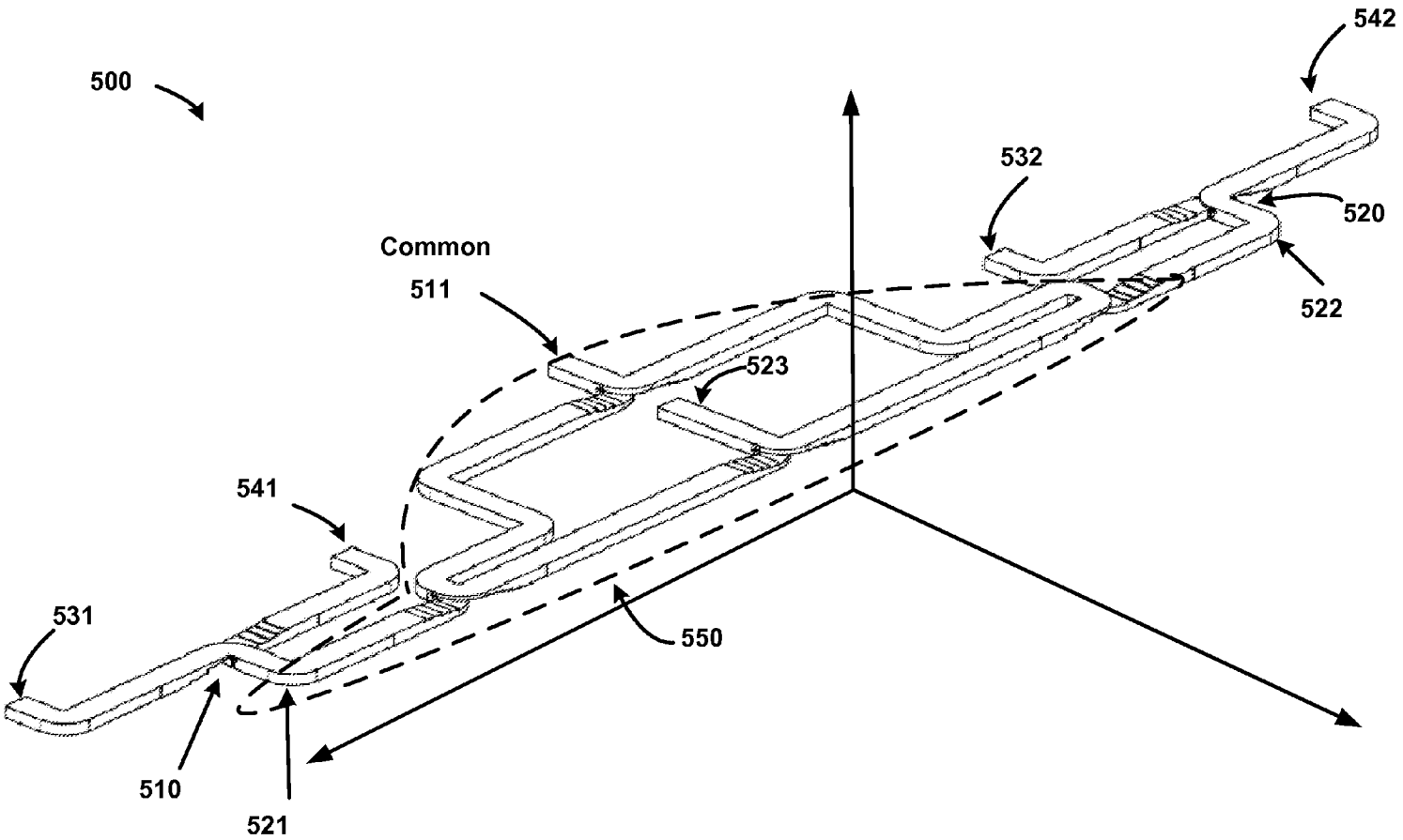
FIG. 5 is a perspective view of an example recombinant five-way (N=5) power combiner/divider comprised of six (N+1) waveguide junctions.

In a different example embodiment, and with reference to FIG. 5, a recombinant five-way power combiner/divider 500 comprises a recombinant three-way power combiner/divider 550, a first two-way WG junction 510, and a second two-way waveguide junction 520. Recombinant three-way power combiner/divider 550 comprises a common port 511, a first port 521, second port 522, and third port 523. In this example embodiment, the two two-way waveguide junctions (510, 520) are respectively connected via their common port to each of the first port 521 and second port 522 of recombinant three-way power combiner/divider 550 to form a five-way recombinant splitter/combiner. The five-way recombinant power combiner/divider 500 can comprise a common port 511, and five output ports 531, 541, 523, 532, and 542. The five-way (N=5) power combiner/divider 500 can comprise six (N+1) junctions.

Figure 6:
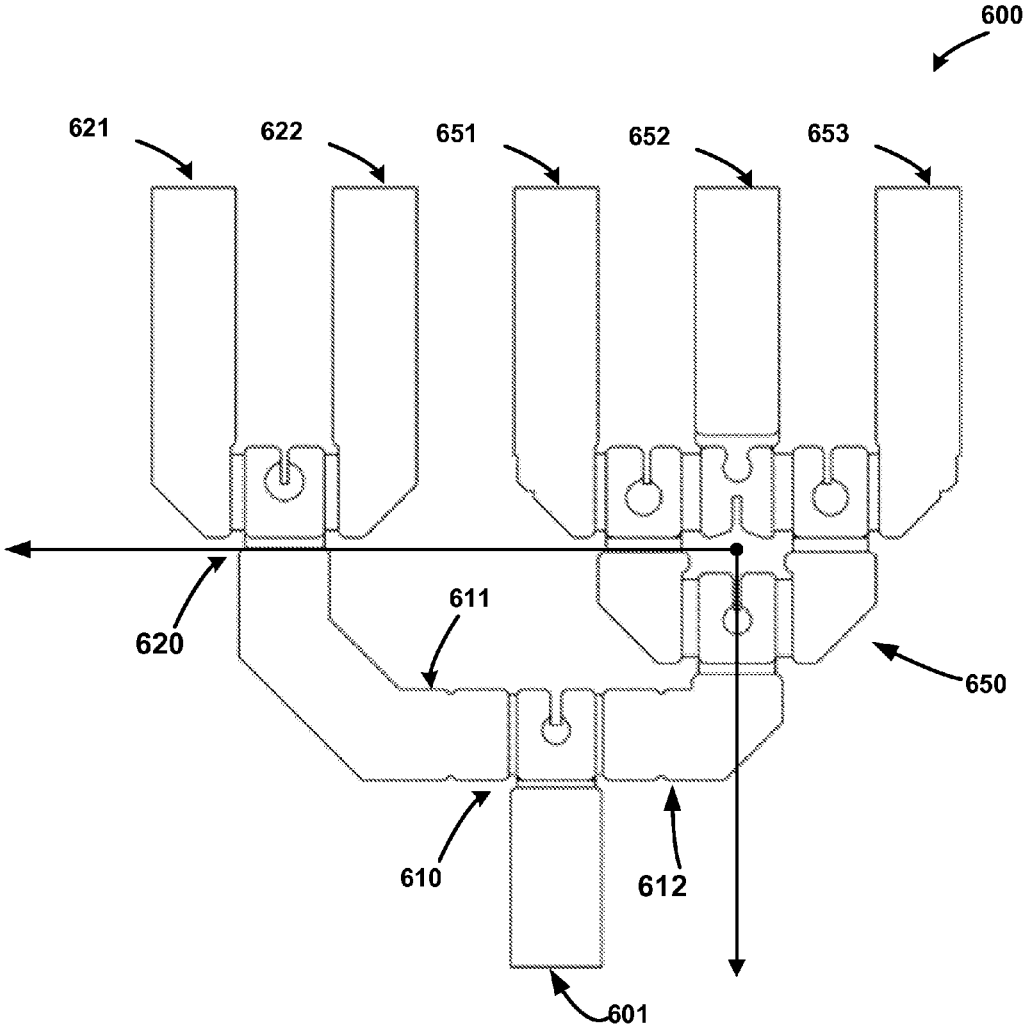
FIG. 6 is a perspective view of another example recombinant five-way (N=5) power combiner/divider comprised of six (N+1) waveguide junctions.

In another example embodiment, and with reference to FIG. 6, a recombinant five-way power combiner/divider 600 comprises a recombinant three-way power combiner/divider 650, a first two-way WG junction 610, and a second two-way waveguide junction 620. In this example embodiment, the second two-way waveguide junctions (620) and the recombinant three-way power combiner 650 are respectively connected via their common port to the first 611 and second 612 WG ports of two-way power combiner/divider 610 to form a five-way recombinant splitter/combiner. The five-way recombinant power combiner/divider 600 can comprise a common port 601, and five output ports 621, 622, 651, 652, and 653. The five-way (N=5) power combiner/divider 600 can comprise six (N+1) junctions.

Moreover, other N-way combinations may be formed that include a three-way recombinant device. Although there is no particular restriction on the value of N in such higher order N-way recombinant devices, from a practical stand point, some embodiments can be more useful than others. For example, a four-way recombinant device may be formed using a three-way recombinant device connected to one port of a two-way device. Alternatively, a four-way device may be built with three two-way devices. Similarly, 8 or 16-way recombinant devices could be formed using three-way recombinant device(s), but such could also be built with six or fifteen two-way devices, respectively.

In an example embodiment, the N-way waveguide recombinant device can comprise reactive junctions—meaning that, in this example embodiment, in each two-way junction there is not a fourth port. For example, in a non-reactive junction, such as a "magic-T," in a receive embodiment, the out-of-phase portion of the receive signal goes into a fourth port, that is often terminated so that this out-of-phase portion does not interfere with the rest of the receive signal. In contrast, the N-way waveguide recombinant device can be constructed as a reactive device so that there are no terminated ports or fourth ports. Conceptually each junction in the N-way waveguide recombinant power combiner/divider structure can be implemented with a "magic-T" but this may not be the preferred embodiment due to the additional space used in the structure for the "fourth ports" and their respective terminations. In an example embodiment, it may be desirable to apply the disclosure herein for application in dense layered beamforming networks for antenna arrays; however, the presence of "fourth ports" could lead to an increase in the layer spacing. In various example embodiments, the increase in size could be undesirable.

In various example embodiments, an N-way recombinant device can be a "conservative power divider/combiner." A conservative power divider/combiner can be configured to comprise no terminated ports. Stated another way, a conservative power divider/combiner can comprise no ports going into loads. Power is effectively lost or dissipated in the ports that are terminated into loads. Thus, a power combiner/divider with no terminated load ports can be a conservative power divider/combiner. As an example, a 12-way device could be formed using a 16-way device formed of standard two-way dividers with four terminated ports. However, this would not be a conservative power divider/combiner. However, in an example embodiment, a conservative power divider/combiner can comprise three-way recombinant devices and no terminated ports. One way of forming such a 12-way device is to attach two three-way recombinant devices to the outputs of a single two-way device, and attach two-way devices to the outputs of the three-way recombinant devices. In this example, N=12 and there can be 15 (N+3) waveguide junctions. Another way of forming such a 12-way device is to attach two two-way devices to the outputs of a single two-way device and attach four three-way recombinant devices to the outputs of the four three-way recombinant devices. In this example, N=12 and there can be 19 (N+5) waveguide junctions.

Further example embodiments can comprise a seven-way recombinant device that can comprise, for example, a three-way recombinant device having two-way devices connected, on their common port, to two of the three output ports of the three-way recombinant device as well as another three-way recombinant device connected, on its common port, to the other of the three output ports of the three-way recombinant device. Thus, two three-way recombinant devices and two two-way devices can be used to create a seven-way recombinant device. In this example, N=7 and there can be 10 (N+3) waveguide junctions.

Similarly, a nine-way recombinant device can comprise, for example, a root three-way recombinant device having three three-way recombinant devices connected, at their respective common ports, to the three output ports of the root three-way recombinant device. In this example, N=9 and there can be 16 (N+7) waveguide junctions. In another example embodiment, a five-way recombinant device can be connected to five eight-way binary devices (comprising two-way devices discussed above) to form a 1:40 divider/combiner device. In this example, N=40 and there can be 41 (N+1) waveguide junctions. In short, a suitable higher order N-way waveguide device may he formed comprising lower order recombinant devices, such as three-way and five-way recombinant devices. In an example embodiment, in cases involving at least one recombinant devices, the number of waveguide junctions can be greater than N.

In particular, in an example embodiment, an N-way recombinant waveguide device can comprise at least one recombinant power divider/combiner, wherein the N-way recombinant device comprises one common port and N output/input ports, wherein N is an integer greater than 2, wherein N is not equal to $2^X$, where X is an integer greater than 2, and wherein the N-way recombinant device is a conservative power divider/combiner.

In an example embodiment, the in-phase recombinant N-way waveguide device can be configured to communicate a first signal in a first band. For example, the first band can be 28.1-30.0 GHz. Moreover, the in-phase recombinant N-way waveguide device can he configured so that the signals in the first band that are communicated via the second, third, and fourth WG ports can be in-phase with each other.

In another example embodiment, the in-phase recombinant N-way waveguide device can be configured to communicate a second signal in a second band. For example, the second band can be 18.3-20.2 GHz. Moreover, the in-phase recombinant N-way waveguide device can be configured so that the signals in the second band that are communicated via the second, third, and fourth WG ports can be in-phase with each other.

Moreover, the in-phase recombinant N-way waveguide device can be configured to communicate a first signal in a first band and a second signal in a second band, simultaneously. For example, the first signal can be transmitted over the first band and the second signal can be received over the second band. Thus, in an example embodiment, the recombinant N-way power combiner/divider is a dual-band device. A dual-band device can be configured to communicate signals at two different frequency bands.

In an example embodiment, the waveguide power distribution networks described herein can be used in an antenna array, such as antenna arrays for Ku and Ka band satellite communications (SATCOM) applications. Such antenna arrays can have advanced non-uniform aperture distribution functions to comply with regulations. For example a discrete "Taylor distribution" with appropriately selected parameters can be used to enable a power distribution for efficiently feeding an array antenna that complies with regulatory masks for radiation pattern envelopes. The Taylor distribution can have a uniform phase distribution and non-uniform amplitude distribution. For that reason, the distribution network can be configured to have precise amplitude and phase control. A departure from the uniform phase objective in the Taylor distribution can result in lower than optimum antenna directivity. Moreover, in various example embodiments, the antenna array can be configured to simultaneously receive and transmit using dual polarized operation at diverse frequency bands. Furthermore, the antenna array can be configured to be used in aerospace applications. Thus, the antenna array (and an in-phase recombinant N-way power combiner/divider used therein) can be configured to have a high level of integration to achieve compactness and light weight relative to comparable antenna arrays that do not employ recombinant combiner/dividers. Moreover, the antenna array can be configured to be mechanically pointed, rotating about one or more axis of rotation. Thus, the antenna array can be a non-electrically scanning array.

Therefore, in an example embodiment, at least one of: the signals in a first band that are communicated via the second, third, and fourth WG ports are in-phase with each other; and the signals in a second band that are communicated via the second, third, and fourth WG ports are in-phase with each other. Thus, the power distribution network can be configured to be an in-phase recombinant N-way power combiner/divider.

Figure 7:
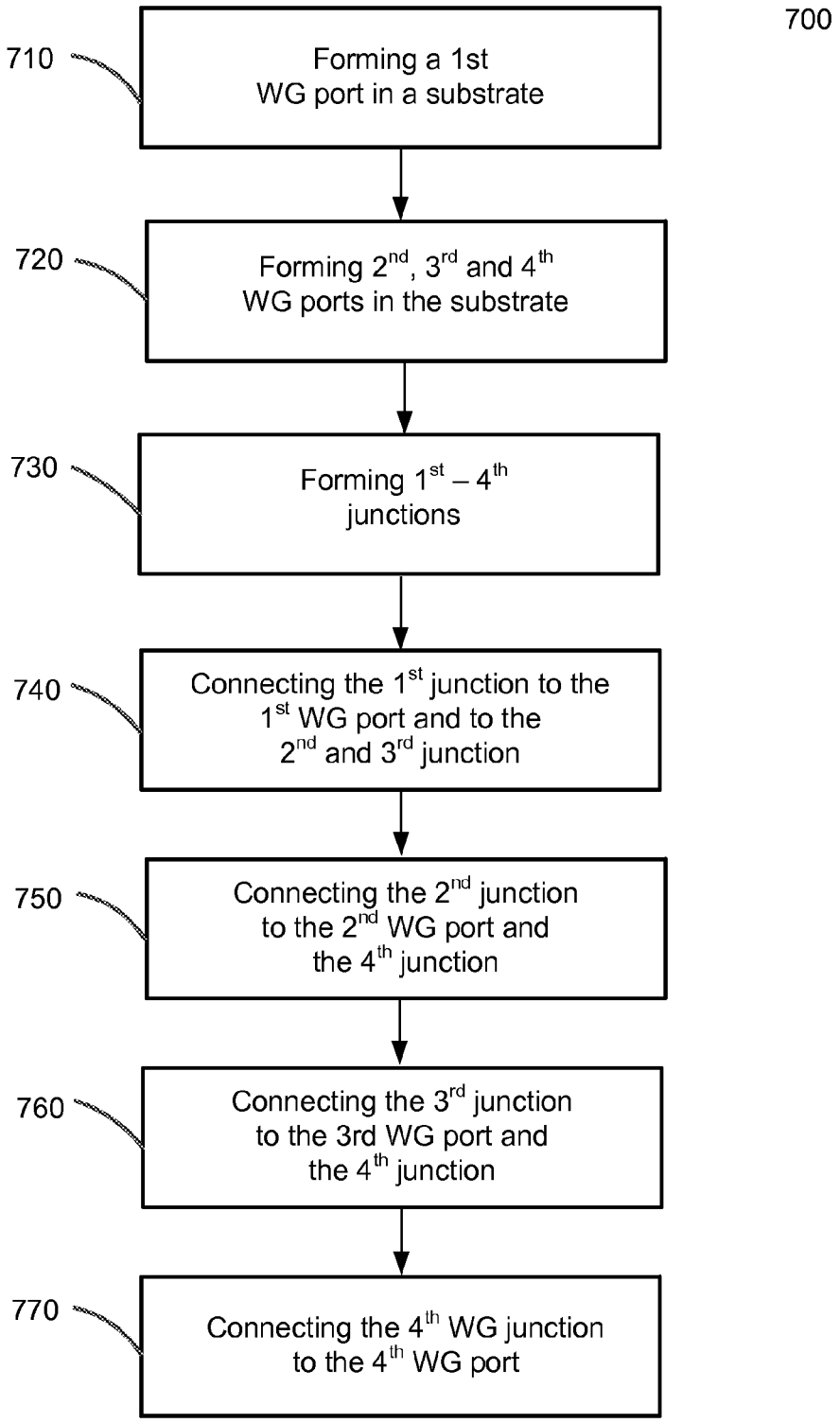
FIG. 7 is a flow chart for an example method disclosed herein.

In accordance with various aspects, and with reference to FIG. 7, a method 700 for building an in-phase recombinant waveguide device is disclosed herein. Method 700 can comprise the operation of forming a first WG port in a substrate (operation 710). The first WG port can he a common port. Various ways of forming ports in a substrate may be used, including for example, electroforming, molding, machining, plating onto a form, and the like. Method 700 can further comprise forming second, third, and fourth WG ports in the substrate (operation 720). In some embodiments, forming the first, second, third and fourth WG ports can occur simultaneously. The recombinant three-way WG device can be configured to simultaneously: distribute a transmit signal provided at the common port as three separate signals respectively at the second, third and fourth WG ports; and combine three receive signals respectively from the second, third and fourth WG ports into a single signal at the first WG port. The recombinant three-way WG device can be configured so that a signal communicated between the common port and the fourth WG port is split before it is combined with a portion of itself. Moreover, at least one of: signals in a first band communicated via the second, third, and fourth WG ports can be in-phase with each other, and signals in a second band communicated via the second, third, and fourth WG ports can be in-phase with each other. In another example embodiment, a signal communicated from the common port is split into at least four signals, of which at least two signals are combined and communicated to the fourth WG port.

In an example embodiment, method 700 further comprises: forming a first junction, forming a second junction, forming a third junction, and forming a fourth junction (operation 730); connecting the first junction to the first WO port and to the second and third junction (operation 740); connecting the second junction to the second WG port and the fourth junction (operation 750); connecting the third junction to the third WG port and the fourth junction (operation 760); and connecting the fourth WG junction to the fourth WG port (operation 770). In general, method 700 can comprise forming more junctions than output ports in a conservative power divider network structure. Stated differently, for a N-way waveguide power divider there can be at least N+1 waveguide junctions.

In one example embodiment, the forming a junction operation further comprises forming an H-plane T-junction with an H-plane septum. In another example embodiment, the forming a junction operation further comprises forming an H-plane T-junction with an E-plane septum.

Method 700 may further comprise forming the in-phase recombinant waveguide device by removing material from a substrate to form waveguides, waveguide ports, and junctions. In one example embodiment, the material is removed from various substrates such that when the substrates are assembled, the assembly forms the in-phase recombinant waveguide device. Moreover, method 700 further comprises attaching a first cover to a first side of the substrate and a second cover to a second side of the substrate opposite the first side, to at least partially enclose the waveguides and junctions. Methods of making a power distribution network are further described in U.S. patent application Ser. No. 13/707,160,entitled "Dual-Circular Polarized Antenna System," and filed Dec. 6, 2012 on the same date as this application, which is incorporated herein by reference in its entirety.

In an example embodiment, a recombinant waveguide device can be implemented in an aluminum substrate. Aluminum offers good conductivity and overall good performance to weight metrics. Aluminum can be a good substrate for high speed machining and can also be dimensionally stable. In an example embodiment, the aluminum substrate is the 6061-T6 aluminum alloy; however, an aluminum substrate may be used. Moreover, a recombinant waveguide device can be formed in any suitable substrate. For example, cast aluminum or zinc can be used but strength and higher porosity factors may be limiting in some high performance applications. In another example, a recombinant waveguide device can be formed in a copper substrate. Copper can offers high performance and, in the case of manufacturing by electroforming, can offer high performance and precision at the expense of higher cost and manufacturing time.

In accordance with an example embodiment, the in-phase recombinant N-way power distribution network can comprise a dominate mode $TE_{10}$ operation in one or more frequency bands. Higher order mode propagation to a significant degree in the structure can be deleterious to the desired performance. Although not limited to wide bandwidth operation and applications, the in-phase recombinant N-way power distribution network can be configured to operate over bandwidth ratios exceeding 1.5:1.

In accordance with an example embodiment, the in-phase recombinant N-way power distribution network can comprise two or more waveguide junctions in close proximity. The distance between waveguide junction centers may be as small as 1.2 to 1.5 times the waveguide width in the recombinant section or recombinant set of junctions.

In accordance with an example embodiment, the in-phase recombinant N-way power distribution network may comprise a flat design, where the waveguides are substantially all in the same plane. For example, the devices of FIGS. 1 and 5 are examples of substantially flat layouts. In another example embodiment, the device may be "stacked," "folded," and/or "layered." For example, with reference to FIGS. 3, 4, and 5, the device is layered to make the device compact. In such an embodiment, the device can comprise waveguides in more than one, typically parallel planes. The planes can be configured to be on top of the other.

In describing the present invention, the following terminology will be used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be appreciated that the particular implementations shown and described herein are illustrative of the invention and its best mode and are not intended to otherwise limit the scope of the present invention in any way. Furthermore, the connecting lines shown in the various figures contained herein are intended to represent exemplary functional relationships and/or physical couplings between the various elements. It should be noted that many alternative or additional functional relationships or physical connections may be present in a practical device.

As one skilled in the art will appreciate, the mechanism of the present invention may be suitably configured in any of several ways. It should be understood that the mechanism described herein with reference to the figures is but one exemplary embodiment of the invention and is not intended to limit the scope of the invention as described above.

It should be understood, however, that the detailed description and specific examples, while indicating exemplary embodiments of the present invention, are given for purposes of illustration only and not of limitation. Many changes and modifications within the scope of the instant invention may be made without departing from the spirit thereof, and the invention includes all such modifications. The corresponding structures, materials, acts, and equivalents of all elements in the claims below are intended to include any structure, material, or acts for performing the functions in combination with other claimed elements as specifically claimed. The scope of the invention should be determined by the appended claims and their legal equivalents, rather than by the examples given above. For example, the operations recited in any method claims may be executed in any order and are not limited to the order presented in the claims. Moreover, no element is essential to the practice of the invention unless specifically described herein as "critical" or "essential."

What is claimed is:

1. A waveguide device comprising:

a first waveguide coupled to each of a second waveguide, a third waveguide and a fourth waveguide via a plurality of waveguide junctions, wherein the plurality of waveguide junctions form:

a first signal path between the first waveguide and the second waveguide;

a second signal path between the first waveguide and the third waveguide; and a third signal path between the first waveguide and the fourth waveguide;

wherein the third signal path includes a first waveguide junction of the plurality of waveguide junctions to divide an input signal into a first divided signal and a second divided signal, and includes a second waveguide junction of the plurality of waveguide junctions to recombine at least a portion of the first divided signal and at least a portion of the second divided signal to form an output signal.

2. The waveguide device of claim 1, wherein the first and second signal paths each include one of the first waveguide junction and the second waveguide junction.

3. The waveguide device of claim 1, wherein the first signal path, the second signal path and the third signal path through the plurality of waveguide junctions are each reciprocal.

4. The waveguide device of claim 1, wherein each of the plurality of waveguide junctions are respectively a reactive junction.

5. The waveguide device of claim 1, wherein the number of waveguides coupled to the first waveguide via the plurality of waveguide junctions is non-binary.

6. The waveguide device of claim 1, wherein the third signal path extends along a first direction and a second direction through the plurality of waveguide junctions, the first direction opposite the second direction.

7. The waveguide device of claim 1, wherein:

the input signal is obtained from the first waveguide and the output signal is provided to the fourth waveguide;

the first signal path includes a third waveguide junction of the plurality of waveguide junctions to divide the first divided signal to form a second output signal provided to the second waveguide; and the second signal path includes a fourth waveguide junction of the plurality of waveguide junctions to divide the second divided signal to form a third output signal provided to the third waveguide.

8. The waveguide device of claim 7, wherein the output signal, the second output signal and the third output signal are in-phase with one another.

9. The waveguide device of claim 7, wherein the output signal, the second output signal and the third output signal have equal amplitudes.

10. The waveguide device of claim 7, wherein:

the third waveguide junction divides the first divided signal into the second output signal and a first intermediate signal;

the fourth waveguide junction divides the second divided signal into the third output signal and a second intermediate signal; and the second waveguide junction combines the first intermediate signal and the second intermediate signal to form the output signal.

11. The waveguide device of claim 1, wherein:

the input signal is obtained from the fourth waveguide and the output signal is provided to the first waveguide;

the first signal path includes a third waveguide junction of the plurality of waveguide junctions to combine the first divided signal and a second input signal obtained from the second waveguide to form a first intermediate signal;

the second signal path includes a fourth waveguide junction of the plurality of waveguide junctions to combine the second divided signal and a third input signal obtained from the third waveguide to form a second intermediate signal; and the second waveguide junction combines the first intermediate signal and the second intermediate signal to form the output signal.

12. The waveguide device of claim 11, wherein:

the third waveguide junction combines the first divided signal and the second input signal in-phase;

the fourth waveguide junction combines the second divided signal and the third input signal in-phase; and the second waveguide junction combines the first intermediate signal and the second intermediate signal in-phase.

13. A waveguide device comprising:

a first waveguide;

a second waveguide coupled to the first waveguide via a first waveguide junction and a second waveguide junction;

a third waveguide coupled to the first waveguide via the first waveguide junction and a third waveguide junction; and a fourth waveguide coupled to the first waveguide via the first waveguide junction, the second waveguide junction, the third waveguide junction and a fourth waveguide junction.

14. The waveguide device of claim 13, wherein each of the first waveguide junction, the second waveguide junction, the third waveguide junction and the fourth waveguide junction is a reactive junction.

15. The waveguide device of claim 13, wherein each of the first, second, third and fourth waveguide junctions include a common port, a first coupled port and a second coupled port.

16. The waveguide device of claim 15, wherein:

the common port of the first waveguide junction is connected to the first waveguide;

the first coupled port of the first waveguide junction is connected to the common port of the second waveguide junction; and the second coupled port of the first waveguide junction is connected to the common port of the third waveguide junction.

17. The waveguide device of claim 16, wherein:

the common port of the fourth waveguide junction is connected to the fourth waveguide;

the first coupled port of the fourth waveguide junction is connected to the first coupled port of the second waveguide junction; and the second coupled port of the fourth waveguide junction is connected to the first coupled port of the third waveguide junction.

18. The waveguide device of claim 15, wherein:

the first waveguide junction divides an input signal obtained from the first waveguide into a first divided signal and a second divided signal; and the fourth waveguide junction recombines a portion of the first divided signal and a portion of the second divided signal to form an output signal provided to the fourth waveguide.

19. The waveguide device of claim 18, wherein:

the second waveguide junction divides the first divided signal into a second output signal and a first intermediate signal, the second output signal provided to the second waveguide;

the third waveguide junction divides the second divided signal into a third output signal and a second intermediate signal, the third output signal provided to the third waveguide; and the fourth waveguide junction combines the first intermediate signal and the second intermediate signal to form a fourth output signal, the fourth output signal provided to the fourth waveguide.

20. The waveguide device of claim 15, wherein:

the fourth waveguide junction divides a first input signal obtained from the fourth waveguide into a first divided signal and a second divided signal;

the second waveguide junction combines the first divided signal and a second input signal obtained from the second waveguide to form a first intermediate signal;

the third waveguide junction combines the second divided signal and a third input signal obtained from the third waveguide to form a second intermediate signal; and the first waveguide junction combines the first intermediate signal and the second intermediate signal to form an output signal, the output signal provided to the first waveguide.

* * * * *